US009993832B2

(12) United States Patent
Breuer et al.

(10) Patent No.: US 9,993,832 B2
(45) Date of Patent: Jun. 12, 2018

(54) VALVE GUN FOR A HIGH-PRESSURE CLEANER

(71) Applicant: Alfred Kärcher GmbH & Co. KG, Winnenden (DE)

(72) Inventors: Christoph Breuer, Fellbach (DE); Daniel Knoedler, Auenwald (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 0 days. days.

(21) Appl. No.: 15/178,201

(22) Filed: Jun. 9, 2016

(65) Prior Publication Data

US 2016/0279655 A1 Sep. 29, 2016

Related U.S. Application Data

(63) Continuation of application No. PCT/EP2013/076456, filed on Dec. 12, 2013.

(51) Int. Cl.

| | |
|---|---|
| ***B05B 12/00*** | (2018.01) |
| ***B05B 9/01*** | (2006.01) |
| ***B05B 1/30*** | (2006.01) |
| ***B08B 3/02*** | (2006.01) |

(52) U.S. Cl.

CPC ..... *B05B 12/002* (2013.01); *B05B 1/302* (2013.01); *B05B 9/01* (2013.01); *B08B 3/026* (2013.01)

(58) Field of Classification Search

CPC ..... B05B 9/01; B05B 12/002; B05B 1/302; B05B 1/3026; B08B 3/026; B08B 3/028

USPC ..... 239/154, 525, 526, 583; 222/153.13, 222/153.14

See application file for complete search history.

(56) References Cited

U.S. PATENT DOCUMENTS

| | | | | |
|---|---|---|---|---|
| 2,079,933 A | | 5/1937 | Fisher | |
| 2,497,625 A | | 2/1950 | Norwick | |
| 2,690,321 A | * | 9/1954 | Luna | F16K 21/04 251/116 |
| 4,225,087 A | * | 9/1980 | Lawlor | B05B 9/01 239/526 |

(Continued)

FOREIGN PATENT DOCUMENTS

| | | |
|---|---|---|
| DE | 374952 | 5/1923 |
| DE | 690 762 | 5/1940 |

(Continued)

*Primary Examiner* — Christopher Kim
*Assistant Examiner* — Cody Lieuwen
(74) *Attorney, Agent, or Firm* — Womble Bond Dickinson (US) LLP

(57) ABSTRACT

A valve gun for a high-pressure cleaner is provided, including an inlet channel with an inlet for supplying a pressurized liquid and an outlet channel with an outlet for discharging the liquid, a valve arranged in the flow path between the inlet and the outlet, a triggering member manually movable between a rest position and a release position for opening and closing the valve, a first locking member manually movable between a locking position and an unlocking position for locking the triggering member in the rest position, and a handgrip graspable by the user. In order to further develop the valve gun such that it is easier to handle, the triggering member can be arranged at the rear side of the handgrip that faces away from the outlet, and that the first locking member can be arranged at the front side of the handgrip that faces the outlet.

22 Claims, 5 Drawing Sheets

(56) References Cited

U.S. PATENT DOCUMENTS

| | | | | |
|---|---|---|---|---|
| 5,118,080 | A | 6/1992 | Hartmann | |
| 6,929,151 | B1 * | 8/2005 | Clayton | F41B 9/0009 141/346 |
| 7,389,949 | B2 | 6/2008 | Marchand et al. | |
| 7,866,573 | B2 | 6/2011 | Stenborg | |
| 2004/0227121 | A1 | 11/2004 | Kassulat et al. | |
| 2006/0131151 | A1 * | 6/2006 | Marchand | B05B 9/01 200/336 |
| 2007/0080242 | A1 | 4/2007 | Wang et al. | |
| 2009/0308892 | A1 * | 12/2009 | Clark | B05B 12/002 222/153.14 |
| 2013/0193236 | A1 * | 8/2013 | Ye | B05B 12/002 239/526 |

FOREIGN PATENT DOCUMENTS

| | | | | |
|---|---|---|---|---|
| DE | 35 18 492 | | 11/1986 | |
| DE | 35 27 922 | | 2/1987 | |
| DE | 38 26 784 | | 2/1990 | |
| DE | 93 16 533 | | 1/1994 | |
| DE | 196 14 663 | | 10/1997 | |
| EP | 1 389 495 | | 2/2004 | |
| EP | 2 165 767 | | 3/2010 | |
| EP | 2 165 768 | | 3/2010 | |
| EP | 2165767 | A1 * | 3/2010 | B05B 1/304 |
| EP | 3130406 | A1 * | 2/2017 | B05B 12/002 |
| GB | 513013 | | 10/1939 | |
| GB | 826699 | | 1/1960 | |
| GB | 2 502 338 | | 11/2013 | |

* cited by examiner

VALVE GUN FOR A HIGH-PRESSURE CLEANER

CROSS-REFERENCE TO RELATED APPLICATIONS

This application is a continuation of international application number PCT/EP2013/076456 filed on Dec. 12, 2013, which is incorporated herein by reference in its entirety and for all purposes.

BACKGROUND OF THE INVENTION

The invention relates to a valve gun for a high-pressure cleaner, comprising an inlet channel with an inlet for supplying a pressurized liquid and an outlet channel with an outlet for discharging the liquid, a valve arranged in the flow path between the inlet and the outlet, a triggering member manually movable between a rest position and a release position for opening and closing the valve, a first locking member manually movable between a locking position and an unlocking position for locking the triggering member in the rest position, and a handgrip graspable by the user with his hand to hold the valve gun.

The discharge of liquid which has been pressurized by a high-pressure cleaner can be controlled by such valve guns. A pressure hose, for example, can be connected to an inlet, and a spray lance, for example, can be connected to an outlet. Liquid under high pressure can be supplied to the valve gun via the pressure hose, and the liquid can be directed at an object via the spray lance. The pressure of the liquid may, for example, be more than 100 bar, in particular, more than 200 bar. To control the discharge of the liquid, the user has the possibility of moving a triggering member from a rest position to a release position. The triggering member is mechanically coupled to a valve arranged in the flow path between the inlet and the outlet. In the rest position of the triggering member, the valve is closed, and in the release position of the triggering member, the valve is open. To avoid unintentional actuation of the triggering member, the valve gun has a first locking member which is manually movable between a locking position and an unlocking position. The triggering member can be locked in the rest position by means of the first locking member. For this purpose, the first locking member assumes its locking position. To unlock the triggering member, the first locking member must be transferred to its unlocking position in which it releases the triggering member.

The valve gun has a handgrip which is constructed in the manner of a pistol grip and can be grasped by the user with his hand.

A valve gun of the kind mentioned at the outset is known from the publication DE 38 26 784 A1. In this valve gun, the triggering member is configured in the form of a pivot lever, which is arranged at the front side of the handgrip that faces the outlet and can be gripped by the user with his fingers when grasping the handgrip and pivoted rearwards in the direction facing away from the outlet. Positioned below the pivot lever is a pivotable locking member constructed in the manner of a locking bar which locks the pivot lever in the rest position. To be able to move the pivot lever into its release position, the user must press the locking member with his fingers out of a recess of the pivot lever. This makes handling of the valve gun difficult.

A valve gun in which the triggering member is also constructed in the form of a pivot lever arranged at the front side of the handgrip that faces the outlet of the valve gun is known from U.S. Pat. No. 7,389,949 B2. To lock the pivot lever in the rest position, a securing lever is used, which is pivotably mounted on the pivot lever and in a first position protrudes rearwards from the pivot lever in the direction facing away from the outlet. When pivoting the pivot lever from the rest position to the release position, the user must transfer the securing lever against a spring-elastic reset force to an unlocking position in which the securing lever is aligned parallel to the pivot lever. The actuation of the pivot lever occurs against the action of the not inconsiderable reset force of the securing lever. During prolonged operation of the valve gun, this may cause fatigue in the user, who has to pull the pivot lever and the securing lever with his fingers towards the handgrip, and, therefore, makes handling of the valve gun difficult.

The object of the present invention is to further develop a valve gun of the generic kind in such a way that it is easier to handle.

SUMMARY OF THE INVENTION

This object is accomplished, in accordance with the invention, in a valve gun of the kind mentioned at the outset in that the triggering member is arranged at the rear side of the handgrip that faces away from the outlet, and in that the first locking member is arranged at the front side of the handgrip that faces the outlet.

With the valve gun in accordance with the invention, the user can grasp the handgrip and, in doing so, he can actuate the triggering member arranged at the rear side of the handgrip with the heel of his hand and the first locking member arranged at the front side of the handgrip with his fingers. When grasping the handgrip, the user can intuitively unlock the triggering member by gripping the first locking member with his fingers and moving it out of the locking position into the unlocking position. The actuation of the triggering member occurs in the direction opposite to the actuation of the first locking member. The triggering member and the first locking member are arranged on the handgrip and can be easily gripped by the user. This facilitates handling of the valve gun.

In the rest position, the triggering member can protrude from the rear side of the handgrip.

In the locking position, the first locking member can protrude from the front side of the handgrip.

When pressurized liquid is discharged by the valve gun, the liquid exerts a recoil on the valve gun. The positioning of the triggering member at the rear side of the handgrip has the consequence that the valve gun is pressed against the heel of the user's hand under the influence of the recoil of the liquid. The heel of the user's hand, consequently, acts in the manner of an abutment against which the valve gun is supported. Therefore, the triggering member does not have to be pressed with great force by the user with his fingers against the handgrip.

In the valve gun in accordance with the invention, the handgrip forms a fixed component, which is arranged between the movable triggering member and the movable first locking member and enables the user to intuitively operate the valve gun.

The triggering member can be moved back and forth between a rest position in which the valve is closed and a release position in which the valve is open. For this purpose, the triggering member is mechanically coupled to the valve. The triggering member may, for example, be mounted so as to be linearly displaceable.

In a particularly preferred configuration of the invention, the triggering member is mounted so as to be pivotable about a first pivot axis. Upon grasping the handgrip, the user can pivot the triggering member with the heel of his hand from the rest position to the release position after he has previously transferred the first locking member to the unlocking position.

The handgrip has an upper end region allocated to the thumb and the index finger of the user and a lower end region facing away from the upper end region. It is advantageous for the first pivot axis to be arranged in the lower end region of the handgrip. When the user grasps the upper end region of the handgrip with his thumb and index finger, he can then simultaneously also grip the region of the triggering member that faces away from the first pivot axis and easily pivot the triggering member from the rest position to the release position.

The first locking member can be moved from a locking position in which it locks the triggering member in the rest position into an unlocking position in which it releases the triggering member. For this purpose, the first locking member can be mounted so as to be linearly displaceable. For example, it may be provided that the first locking member, in its locking position, protrudes from the front side of the handgrip that faces the outlet of the valve gun and is displaceable rearwards in the direction of the handgrip in order to release the triggering member.

It is particularly expedient for the first locking member to be mounted so as to be pivotable about a second pivot axis. This makes a constructionally particularly simple design of the valve gun possible.

The second pivot axis is expediently aligned parallel to the first pivot axis.

As mentioned above, the handgrip has an upper end region allocated to the thumb and the index finger of the user and a lower end region facing away from the upper end region. The second pivot axis is preferably arranged in the upper end region of the handgrip or in a housing region of the valve gun adjacent to the upper end region of the handgrip. For example, it may be provided that the handgrip protrudes from a rear housing region of the valve gun facing away from the outlet of the valve gun and the second pivot axis is arranged in the rear housing region.

In an advantageous embodiment of the invention, the first locking member comprises an actuating arm and a locking arm, the actuating arm, in the locking position of the first locking member, protruding from the front side of the handgrip, and the locking arm, in the locking position of the first locking member, blocking movement of the triggering member from the rest position to the release position. For this purpose, the locking arm can lie with or without play against the triggering member.

It is expedient for the locking arm, in the locking position of the locking member, to lie with its free end with play or without play against the triggering member.

The actuating arm and the locking arm are preferably aligned at an angle to each other.

It may be provided that the first locking member is of L-shaped construction, with the actuating arm forming a first leg and the locking arm a second leg of the first locking member.

The locking arm preferably has at its free end a freely rotatable roller with which it lies with or without play against the triggering member in the locking position of the first locking member. When the first locking member is pivoted from the locking position to the unlocking position, the roller arranged at the free end of the locking arm can roll off the triggering member and release it.

In an advantageous embodiment of the invention, the locking arm, in the unlocking position of the first locking member, extends into a recess of the triggering member. The triggering member may, for example, have a depression which receives the locking arm in the unlocking position of the first locking member.

In order to keep the risk of inadvertent actuation of the triggering member particularly low, the valve gun comprises, in an advantageous embodiment of the invention, a second locking member which is movable back and forth between a locking position and an unlocking position, the triggering member being lockable in the locking position and releasable in the unlocking position by the second locking member. In such an embodiment, the valve gun has two locking members which are actuatable independently of each other. If the triggering member is to be actuated, the user must move both the first locking member and the second locking member from a locking position to an unlocking position.

It is advantageous for the second locking member to be movably mounted on a region of the triggering member which, in the rest position of the triggering member, protrudes from the handgrip, the second locking member, in its locking position, protruding from the triggering member, and, in its unlocking position, extending fully into the triggering member. In its locking position, the second locking member blocks movement of the triggering member in the direction towards the handgrip, and in the unlocking position of the second locking member, the triggering member, can, insofar as the first locking member is also located in its unlocking position, be moved in the direction towards the handgrip. The second locking member may, for example, be mounted on the triggering member so as to be displaceable parallel to the first pivot axis. The triggering member preferably has in its region protruding from the handgrip in the rest position an opening in which the second locking member is displaceably mounted.

The valve of the valve gun mentioned at the outset expediently comprises a closing body which, in a closed position, lies tight against a valve seat and can be acted upon by a valve plunger with an opening force to move the closing body into an open position at a distance from the valve seat. The valve seat is arranged in the flow path between the inlet and the outlet of the valve gun. When the closing body assumes its closed position, it interrupts the flow connection between the inlet and the outlet. When the closing body assumes its open position, it releases the flow connection between the inlet and the outlet.

The triggering member is expediently coupled to the valve plunger via a coupling lever mounted so as to be pivotable about a coupling lever axis. When moving from the rest position into the release position, the triggering member exerts a triggering force on the coupling lever so that it is pivoted about the coupling lever axis and thereby exerts via the valve plunger an opening force on the closing body. The interconnection of the coupling lever between the triggering member and the valve plunger makes it possible to reduce the actuating force required to open the valve, which has to be exerted by the user on the triggering member.

The triggering member can be configured as triggering lever pivotable about the first pivot axis, which is coupled via the coupling lever to the valve plunger.

It may, however, also be provided that the triggering member is constructed as slide member displaceable on the handgrip, which is coupled via the coupling lever to the valve plunger and during transfer from the rest position to the release position is pushed into the handgrip.

The coupling lever has an actuating element via which the valve plunger can be acted upon with the opening force. It is expedient for the actuating element to be adjustable.

It is advantageous for the actuating element to be constructed as adjustment screw, which is screwable into an internal thread of the coupling lever.

Particularly easy handling is achieved with a valve gun of the kind mentioned at the outset, in particular, with a valve gun of the kind explained above by the coupling lever comprising a first and a second force receiving element, the first force receiving element being acted upon first and the second force receiving element subsequently with a triggering force when the triggering member is moved from the rest position into the release position, the first force receiving element being at a greater distance from the coupling lever axis than the second force receiving element. In order to pivot the coupling lever about the coupling lever axis, it can be acted upon with a triggering force. For this purpose, the coupling lever expediently comprises a first force receiving element and a second force receiving element. The first force receiving element is arranged at a greater distance from the coupling lever axis than the second force receiving element. When the triggering member is moved from its rest position into its release position, the coupling lever is first acted upon with a triggering force via the first force receiving element and when the triggering member is moved further, the coupling lever is acted upon with a triggering force via the second force receiving element. The lever ratios of the coupling lever therefore change during the transition from the rest position to the release position of the triggering member. In a first phase of the transition, owing to the favorable lever ratio resulting from the relatively large distance between the first force receiving element and the coupling lever axis, a large opening force can be exerted on the valve plunger even if the user acts with only a relatively low actuating force on the triggering member. The large distance between the first force receiving element and the coupling lever axis has the consequence that during the first phase of the movement of the triggering member only a relatively small stroke of the valve plunger, i.e., only a relatively small displacement path of the valve plunger can be achieved. However, this relatively small stroke is sufficient to lift the closing body off the valve seat of the valve to such an extent that the pressure of the liquid upstream of the valve seat is considerably reduced. In a second phase of the movement of the triggering member, the coupling lever is then acted upon via the second force receiving element, which is at a shorter distance from the coupling lever axis than the first force receiving element. The shorter distance of the second force receiving element has the consequence that a larger displacement path of the valve plunger can be achieved and so the closing body of the valve can be transferred to a relatively large distance from the valve seat.

Expediently, the distance of the closing body from the valve seat, in the open position of the closing body, is at least 1 mm, in particular, approximately 2 mm. Flow loses of the liquid while flowing through the valve can thereby be kept low.

In such a configuration, the valve gun is characterized by particularly easy handling as the user only has to exert a relatively low actuating force on the triggering member arranged at the rear side of the handgrip and yet the valve plunger can be acted upon with a high opening force. The recoil of the liquid presses the valve gun against the heel of the user's hand and thereby supports the actuation of the triggering member, which must be previously unlocked manually by the user by moving the at least one locking member into the position unlocking the triggering member.

The force ratios for actuation of the valve gun are influenced in a constructionally simple way by the configuration of the coupling lever, via which the triggering member is coupled to the valve plunger. The valve plunger is acted upon with the opening force by the actuating element of the coupling lever. The distance of the actuating element from the coupling lever axis can be chosen small. In particular, it may be provided that the distance of the actuating element from the coupling lever axis is approximately one tenth of the distance of the first force receiving element from the coupling lever axis.

The distance of the second force receiving element from the coupling lever axis is expediently approximately 40% to 80%, in particular, approximately 65% to 75% of the distance of the first force receiving element from the coupling lever axis.

It is expedient for the triggering member to comprise a first and a second force application element, the first force receiving element of the coupling lever being positionable on the first force application element, and the second force receiving element of the coupling lever being positionable on the second force application element. When the triggering member is moved from its rest position into its release position, the first force receiving element of the coupling lever first contacts the first force application element of the triggering member, and so the coupling lever is pivoted about the coupling lever axis and thereby acts upon the valve plunger with a high opening force. After completion of the first phase of the movement of the triggering member, the second force receiving element of the coupling lever contacts the second force application element of the triggering member, and so the pivotal movement of the coupling lever is continued, with a lower opening force now being exerted on the valve plunger by the actuating element of the coupling lever, but with the valve plunger being able to be displaced a considerable distance.

It is advantageous for the first force receiving element and the first force application element to form a first guide surface and a first contact element contacting the first guide surface and movable along the first guide surface, and for the second force receiving element and the second force application element to form a second guide surface and a second contact element contacting the second guide surface and movable along the second guide surface.

In order to keep the actuating force required to lift the closing body off the valve seat, which the user must exert on the triggering member, particularly low, provision is made in an advantageous configuration for the angle of inclination of the tangent of the first guide surface at the momentary contact point of the first contact element in relation to a reference line oriented parallel to a longitudinal axis of the outlet channel to be smaller than the angle of inclination of the tangent of the second guide surface at the momentary contact point of the second contact element in relation to the reference line. In such a configuration of the invention, when the triggering member is moved from the rest position into the release position, the first contact element first moves along the first guide surface, with the first contact element contacting the first guide surface, and, subsequently, the second contact element moves along the second guide surface, with the second contact element contacting the second guide surface. The first guide surface is of such construction that the tangent of the first guide surface at the momentary contact point at which the first contact element contacts the first guide surface when it moves along the first guide surface is at an inclination to a reference line. The second guide surface is of such construction that the tangent of the second guide surface at the momentary contact point at which the second contact element contacts the second guide surface when it moves along the second guide surface is also at an inclination to the reference line. The angle of inclination between the tangent of the first guide surface and the reference line is smaller than the angle of inclination between the tangent of the second guide surface and the reference line. The reference line is aligned parallel to a longitudinal axis of the outlet channel. During the first phase of the movement of the triggering member, the first contact element moves along the first guide surface, and via the first guide surface and the first contact element, a first triggering force is transferred from the triggering member onto the coupling lever. During the second phase of the movement of the triggering member, the second contact element moves along the second guide surface, and via the second guide surface and the second contact element, a second triggering force is transferred from the triggering member onto the coupling lever. The smaller angle of inclination of the tangent of the first guide surface has the consequence that during the first phase of the movement of the triggering member, the coupling lever is not pivoted to such a great extent as during the second phase of the movement of the triggering member. The triggering member can, therefore, be moved with relatively little force during the first phase of its movement. During the second phase of the movement, the coupling lever is pivoted to a greater extent owing to the larger angle of inclination of the tangent of the second guide surface, and so a considerable lift of the closing body can be achieved. The angle of inclination between the tangent of the first guide surface at the momentary contact point of the first contact element and the reference line is decisive for the extent of the pivotal movement of the coupling lever in the first phase of the movement of the triggering member. The larger the angle of inclination, the greater is the extent of the pivotal movement of the coupling lever.

The inclination of the tangent of the first guide surface at the momentary contact point of the first contact element in relation to the reference line may be, for example, approximately 10° to 45°, in particular, approximately 15° to 35°.

The inclination of the tangent of the second guide surface at the momentary contact point of the second contact element in relation to the reference line may be, for example, 55° to 85°, in particular, 60° to 80°.

The first guide surface and/or the second guide surface may be arcuately curved.

In a preferred embodiment, the first guide surface and the second guide surface are of flat configuration. In such an embodiment, the two guide surfaces each form an inclined plane along which the first contact element and the second contact element, respectively, move when the triggering member is moved. The first guide surface forms in combination with the first contact element a first wedge gear, and the second guide surface forms in combination with the second contact element a second wedge gear. The triggering member is mechanically connected to the coupling lever via the two wedge gears.

The first guide surface and/or the second guide surface are preferably aligned parallel to the coupling lever axis.

It is expedient for the first guide surface and the second guide surface to be arranged on the triggering member, and for the first contact element and the second contact element to be arranged on the coupling lever.

Alternatively, it may also be provided that the first guide surface and the second guide surface are arranged on the coupling lever and the first contact element and the second contact element are arranged on the triggering member.

In an advantageous embodiment, the first contact element and/or the second contact element are configured as freely rotatable contact rollers. The contact rollers may, for example, be rotatably mounted on the coupling lever.

In a preferred configuration, the first guide surface and the second guide surface are arranged at an end face of the triggering member that faces the coupling lever.

When the closing body of the valve is in its open position, pressurized liquid flows around it and, expediently, it is, in addition, acted upon with a closing force by a closing spring of the valve. The user must, therefore, act upon the triggering member with a certain holding force in order to hold the closing body in its open position. This may cause user fatigue. To achieve particularly simple handling of the valve gun, it is, therefore, desirable to reduce the necessary holding force. For this purpose, provision is made, in an advantageous embodiment for the second contact element, in the release position of the triggering member, to lie against a support surface, with the angle of inclination of the tangent of the support surface in relation to the reference line explained above being smaller than the angle of inclination of the tangent of the second guide surface at the momentary contact point of the second contact element in relation to the reference line. As mentioned above, owing to the provision of the second guide surface and the second contact element, during the second phase of the movement of the triggering member, a relatively large displacement path of the valve plunger can be achieved by the angle of inclination of the tangent of the second guide surface in relation to the reference line having a relatively large value. When the closing body reaches its open position at the end of the movement of the triggering member, further displacement of the valve plunger is no longer necessary and the closing body must then be held in its open position. For this purpose, in the release position of the triggering member, the second contact element assumes a position on a support surface. The inclination of the support surface to the reference line is smaller than the inclination of the tangent of the second guide surface to the reference line. The smaller the angle of inclination of the tangent of the support surface, the lower is the holding force which the user must exert on the triggering member.

The support surface is expediently of flat configuration.

The second coupling element is preferably arranged on the coupling lever, and the support surface is arranged on the triggering member.

It is expedient for the support surface to be arranged at the end face of the triggering member that faces the coupling lever between the first guide surface and the second guide surface. In such a configuration, both the first and second guide surfaces and the support surface are arranged at the end face of the triggering member that faces the coupling lever. Here the support surface assumes a position between the first guide surface and the second guide surface.

The following description of an advantageous embodiment of the invention will serve in conjunction with the drawings for further explanation.

DETAILED DESCRIPTION OF THE INVENTION

Figure 1:
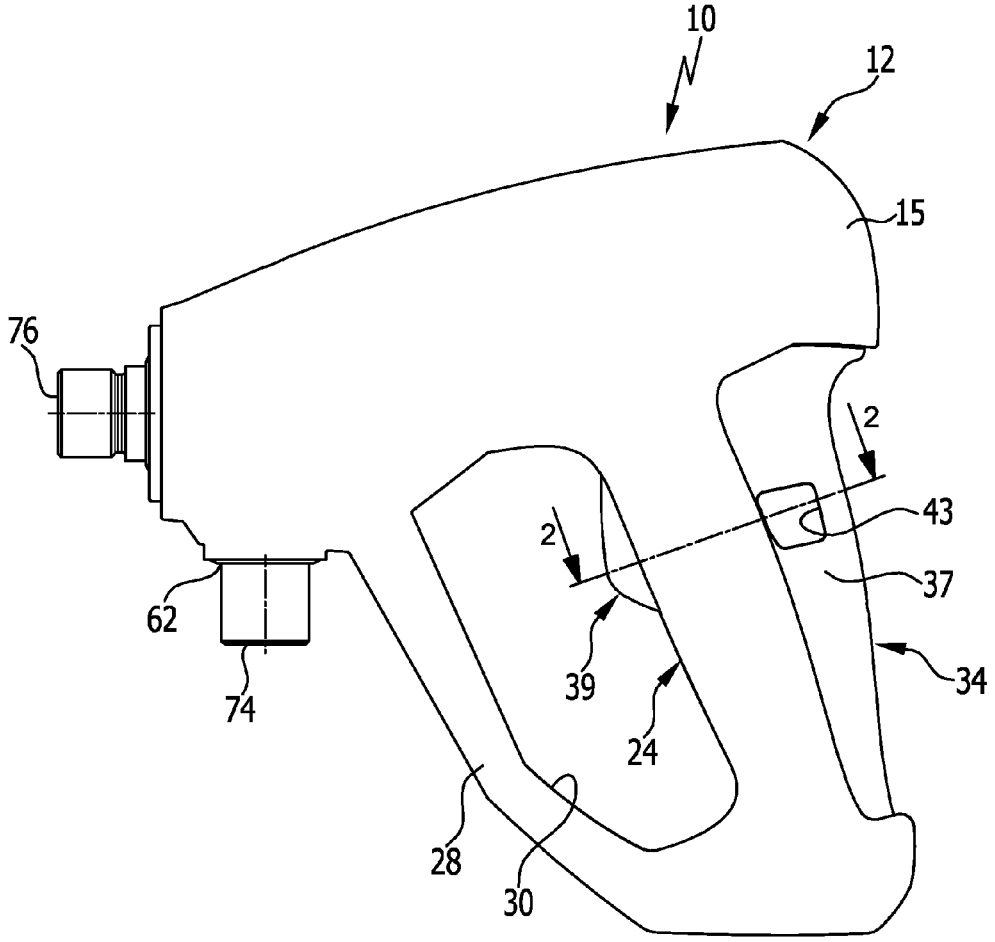
FIG. 1 shows a schematic side view of an advantageous embodiment of a valve gun.

An advantageous embodiment of a valve gun in accordance with the invention is shown schematically in FIGS. 1 to 6 and denoted therein in its entirety by reference numeral 10. The valve gun 10 comprises a housing 12, which is formed by a first housing shell 14 and a second housing shell 15. The housing 12 has a central housing region 16 arranged between a front housing region 18 and a rear housing region 22. The front housing region 18 accommodates a valve 20, and a handgrip 24 which the user can grasp with his hand protrudes from the rear housing region 22. The handgrip has an upper end section 25 allocated to the thumb and the index finger of the user and adjoining the rear housing region 22. Facing away from the upper end region 25, the handgrip 24 has a lower end region 26 from which a guard bracket 28 extends to the front housing region 18. The guard bracket 28, the central housing region 16 and the handgrip 24 surround a grip opening 30 which the user can engage with his fingers when grasping the handgrip 24.

The central housing region 16 accommodates a coupling lever 32, and arranged in the handgrip 24 is a movable triggering member which, in the advantageous embodiment shown, is configured as triggering lever 34. The triggering lever 34 is mounted on the two housing shells so as to be pivotable about a first pivot axis 36 and can be pivoted by the user with the heel of his hand from a rest position shown in FIGS. 1 to 4 via an intermediate position shown in FIG. 5 to a release position shown in FIG. 6. The first pivot axis 36 is arranged in the lower end region 26 of the handgrip 24. In its rest position, the triggering lever 34 protrudes with a rear lever region 37 from the rear side of the handgrip 24 that faces away from the valve 20.

The triggering lever 34 is acted upon by a first return spring 38 with a spring-elastic reset force.

The triggering lever 34 can be locked in its rest position shown in FIGS. 1 to 4. For this purpose, a first locking member 39 is arranged at the front side of the handgrip 24 that faces the valve 20, and a second locking member 40 is arranged at the rear lever region 37.

The first locking member 39 is of substantially L-shaped configuration and is mounted so as to be pivotable about a second pivot axis 41. A first leg 42 of the first locking member 39 forms an actuating arm and, in the locking position of the first locking member 39 shown in FIGS. 1 to 4, protrudes from the front side of the handgrip 24 that faces the valve 20. Arranged at the free end 44 of a second leg 46 of the first locking member 39 is a freely rotatable locking roller 45 which, in the locking position of the first locking member 39, lies loosely against the triggering lever 34 and prevents pivotal movement thereof. The second leg 46 forms a locking arm of the first locking member 39.

Figure 5:
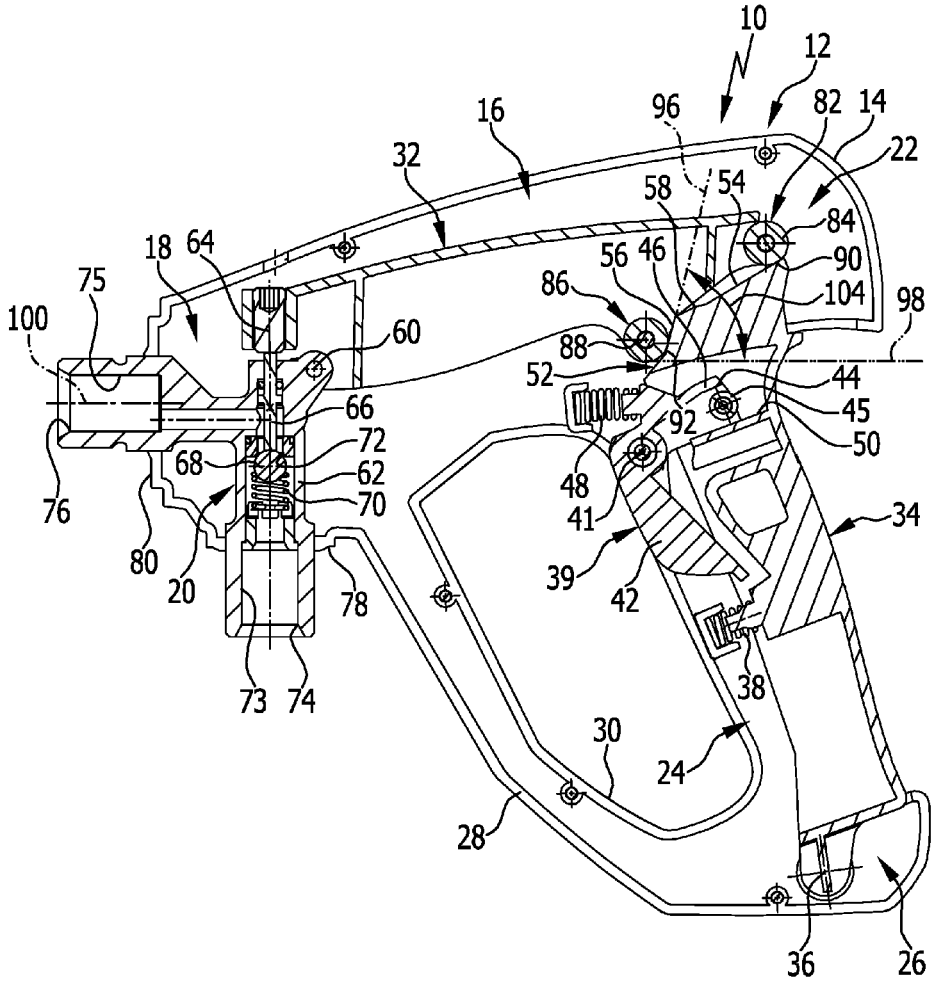
FIG. 5 shows a schematic sectional view of the valve gun from FIG. 1, with the triggering member assuming an intermediate position.
Figure 6:
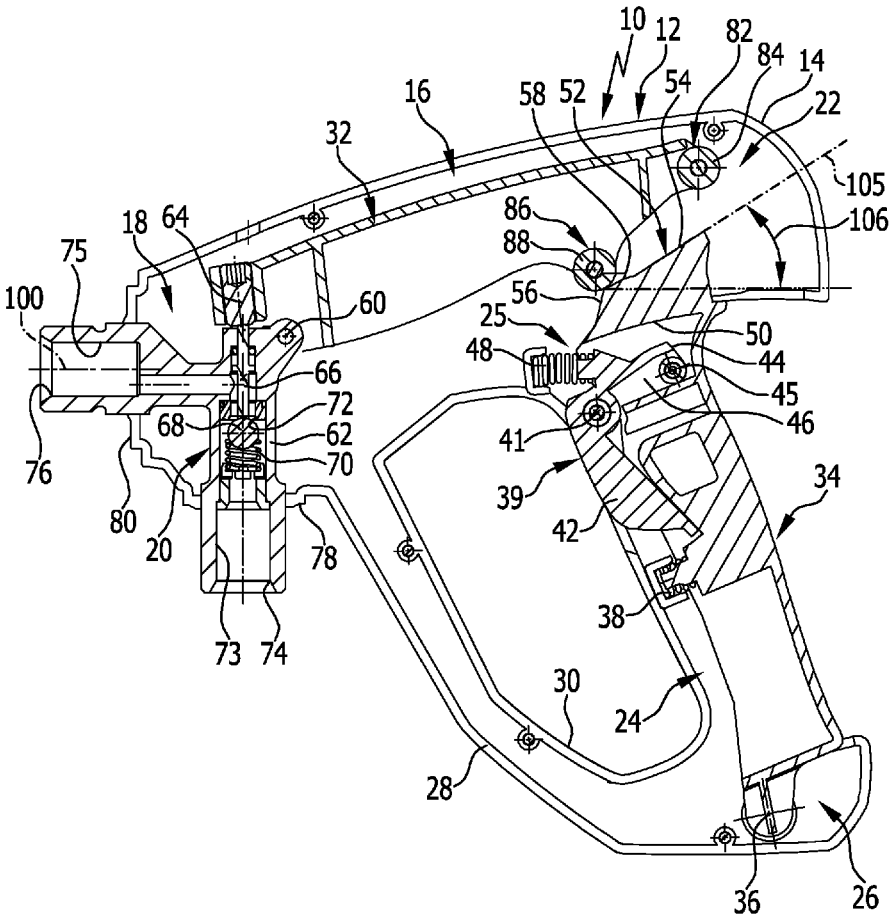
FIG. 6 shows a schematic sectional view of the valve gun from FIG. 1, with the triggering member assuming a release position.

When the user grasps the handgrip 24 with his hand, with his fingers he intuitively pivots the first locking member 39 against the spring-elastic reset force of a second return spring 48 to an unlocking position shown in FIGS. 5 and 6, in which the second leg 46 of the first locking member 39 extends into a recess 50 of the triggering lever 34, and so the triggering lever 34 can be pivoted from its rest position to its release position. When the user releases the handgrip 24 again, the triggering lever 34 is automatically pivoted by the first return spring 38 to its rest position, and the first locking member 39 is automatically pivoted by the second return spring 48 to its locking position, and so the triggering lever 34 is locked again.

Figure 2:
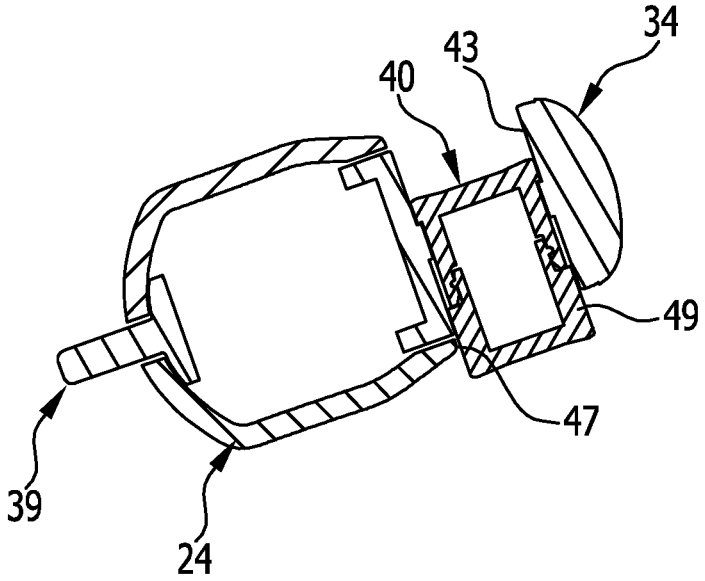
FIG. 2 shows a sectional view of the valve gun taken along line 2-2 in FIG. 1, with a second locking member assuming a locking position.
Figure 3:
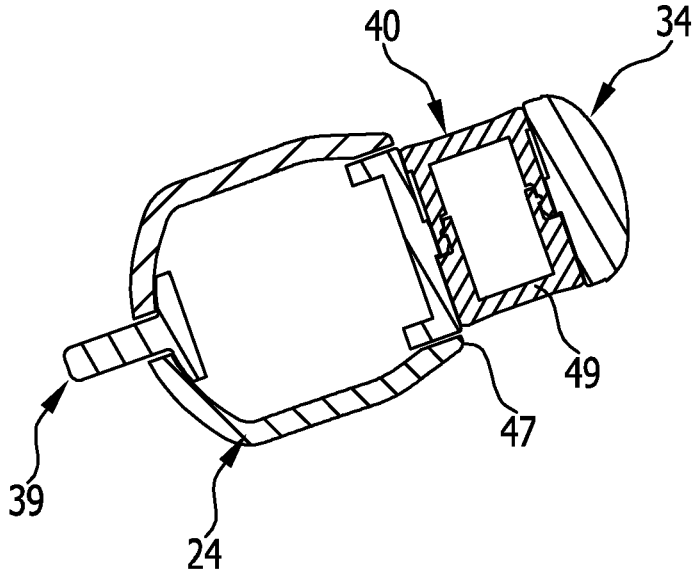
FIG. 3 shows a sectional view corresponding to FIG. 2, with the second locking member assuming an unlocking position.
Figure 4:
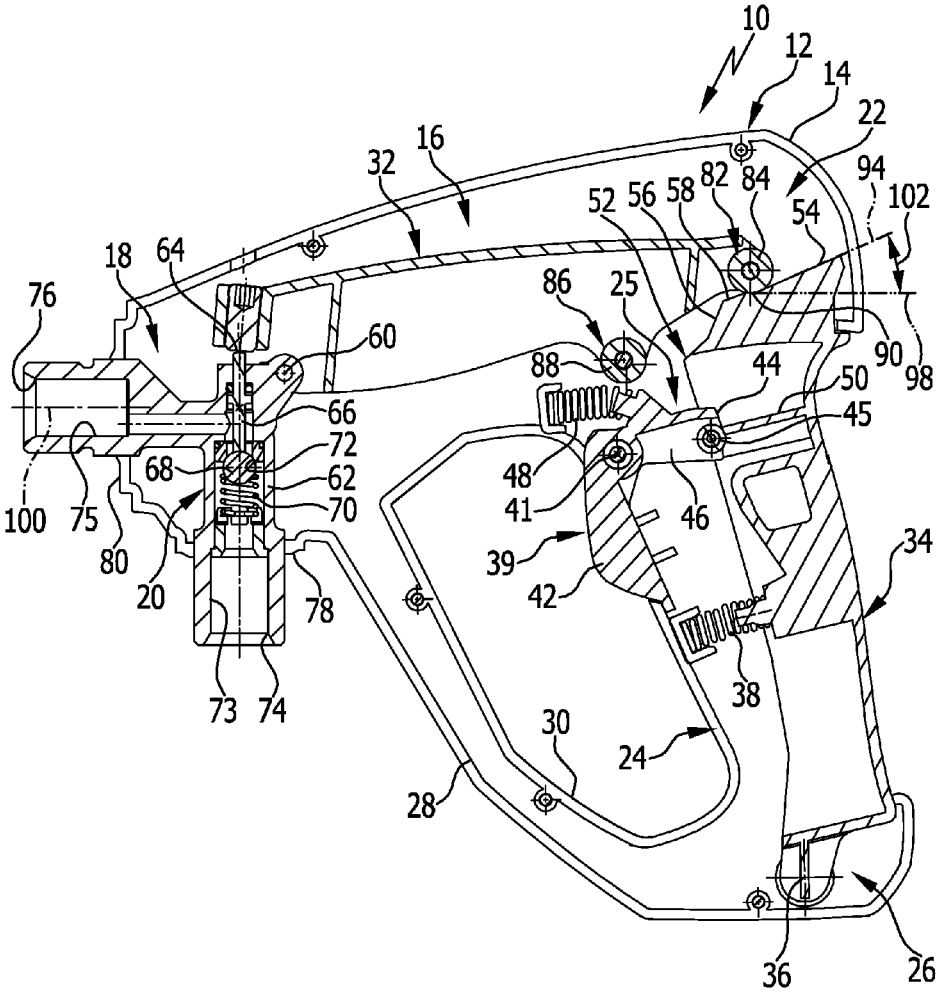
FIG. 4 shows a schematic sectional view of the valve gun from FIG. 1, with a triggering member assuming a rest position.

The second locking member 40 is mounted in an opening 43 of the rear lever region 37 so as to be displaceable back and forth between a locking position shown in FIG. 2 and an unlocking position shown in FIG. 3 parallel to the first pivot axis 36. Owing to its positioning in the rear lever region 37, the opening 43 is arranged behind the handgrip 24 in the rest position of the triggering lever 34. Therefore, in the rest position of the triggering lever 34, the second locking member 40, which is constructed in the manner of a bolt, can be moved into the locking position in which it protrudes with a partial region 49 from the opening 43 and lies against a rear edge 47 of the handgrip 24. The triggering lever 34 is thereby blocked and cannot be pivoted from its rest position to its release position. To release the triggering lever 34, the second locking member 40 must be fully pushed into the opening 43 so that the second locking member 40 releases the rear edge 47 of the handgrip 24. In this unlocking position, the triggering lever 34 can be pivoted to the release position without being impeded by the second locking member 40.

The triggering lever 34 has at its end face 52 facing away from the first pivot axis 36 and facing the coupling lever 32 a first force application element in the form of a first flat guide surface 54 and a second force application element in the form of a second flat guide surface 56, and arranged between the first guide surface 54 and the second guide surface 56 at the end face 52 of the triggering lever 34 is a flat support surface 58.

The coupling lever 32 is pivotable about a coupling lever axis 60. The coupling lever axis 60 is aligned parallel to the first pivot axis 36 and arranged on a valve housing 62 of the valve 20. At a short distance from the coupling lever axis 60, the coupling lever 32 has an adjustable actuating element 64 in the form of an adjustment screw, which lies against a valve plunger 66. The valve plunger 66 is mounted for displacement in the valve housing 62 and lies with its end facing away from the actuating element 64 against a spherical closing body 68 of the valve 20, which is acted upon by a third return spring 70 with a spring-elastic closing force in the direction towards a valve seat 72.

The valve housing 62 forms an inlet channel 73 of the valve gun 10 with an inlet 74 and an outlet channel 75 of the valve gun 10 with an outlet 76. The inlet 74 protrudes from an underside 78 of the front housing region 18 and the outlet 76 protrudes from a front side 80 of the front housing region 18. A liquid supply line, for example, a pressure hose, can be connected to the inlet 74, and pressurized liquid can be supplied to the valve gun 10 via the liquid supply line. A spray lance, for example, can be connected to the outlet 76, and the pressurized liquid can be discharged via the spray lance.

The valve seat 72 is arranged in the flow path between the inlet 74 and the outlet 76. When the closing body 68 is in its closed position shown in FIG. 4, it lies tight against the valve seat 72, and so the flow connection between the inlet 74 and the outlet 76 is interrupted. In its closed position, the closing body 68 is acted upon by the pressure of the liquid prevailing upstream of the valve seat 72. By means of the valve plunger 66, the closing body 68 can be lifted off the valve seat 72 against the reset force of the third return spring 70 and against the pressure of the liquid acting on the closing body 68, so that it releases the flow connection between the inlet 74 and the outlet 76. The liquid pressure prevailing upstream of the valve seat 72 in the closed position of the closing body 68 is thereby reduced.

The coupling lever 32 has at its end facing away from the actuating element 64 a first force receiving element in the form of a first contact element 82 which, in the illustrated embodiment, is configured as first contact roller 84 freely rotatably mounted on the coupling lever 32.

At a distance from the first contact element 82, the coupling lever 32 has on its underside facing the handgrip 24 a second force receiving element in the form of a second contact element 86 which, in the illustrated embodiment, is configured as second contact roller 88 freely rotatably mounted on the coupling lever 32. The distance of the second contact roller 88 from the coupling lever axis 60 is smaller than the distance of the first contact roller 84 from the coupling lever axis 60. Expediently, the distance of the second contact roller 88 from the coupling lever axis 60 is approximately 40% to 80% of the distance of the first contact roller 84 from the coupling lever axis 60.

The distance between the actuating element 64 and the coupling lever axis 60 is preferably about 10% of the distance between the first contact roller 84 and the coupling lever axis 60.

In the rest position of the triggering lever 34 shown in FIGS. 1 to 4, the first contact roller 84 lies against the first guide surface 54 of the triggering lever 34 or assumes a short distance from the first guide surface. When the triggering lever 34 is pivoted from its rest position about the first pivot axis 36, the first contact roller 84 rolls along the first guide surface 54 until the first contact roller 84 reaches the rear end of the first guide surface 54 that faces away from the support surface 58. The region of the first guide surface 54 in which the first contact roller 84 momentarily contacts the first guide surface 54 forms a momentary first contact point 90. With the change in position of the first contact roller 84, the position of the momentary first contact point 90 also changes. During this first phase of the pivotal movement of the triggering lever 34, the coupling lever 32 is pivoted about the coupling lever axis 60 to such an extent that the closing body 68 is lifted off the valve seat 72 and, as a result, the pressure of the liquid prevailing upstream of the valve seat 72 is reduced.

When the first contact roller 84 reaches the rear end of the first guide surface 54 that faces away from the valve 20, as shown in FIG. 5, the second contact roller 88 then contacts the front end of the second guide surface 56 that faces the valve 20. The region of the second guide surface 56 in which the second contact roller 88 momentarily contacts the second guide surface 56 forms a momentary second contact point 92. When the triggering lever 34 is pivoted further to its release position, the second contact roller 88 rolls along the second guide surface 56, and the coupling lever 32 is pivoted further about the coupling lever axis 60 and thereby displaces the valve plunger 66 so that the closing body 68 finally assumes a significant distance from the valve seat 72.

When the triggering lever 34 reaches its release position shown in FIG. 6, the second contact roller 88 assumes a position on the support surface 58.

The first guide surface 54, as well as the second guide surface 56, forms an inclined plane. The first guide surface 54 has a first tangent 94 at the first contact point 90, and the second guide surface 56 has a second tangent 96 at the second contact point 92. In relation to a reference line 98 oriented parallel to a longitudinal axis 100 of the outlet channel 75, the first tangent 94 is inclined at a first angle of inclination 102. The second tangent 96 is inclined at a second angle of inclination 104 in relation to the reference line 98. The first angle of inclination 102 is smaller than the second angle of inclination 104. For example, it may be provided that the first angle of inclination 102 is 10° to 45°, in particular, 15° to 35°, whereas the second angle of inclination 104 is, for example, 55° to 85°, in particular, 60° to 80°.

Since the first angle of inclination 102 is chosen smaller than the second angle of inclination 104, during a first phase of the pivotal movement of the triggering lever 34, the coupling lever 32 is pivoted about a relatively small pivot angle as long as the first contact roller 84 rolls on the first guide surface 54, and, subsequently, during a second phase of the pivotal movement of the triggering lever 34, the coupling lever 32 is pivoted about a larger pivot angle, as long as the second contact roller 88 rolls on the second guide surface 56. The consequence of the larger distance between the first contact roller 84 and the second pivot axis 60 in combination with the smaller angle of inclination 102 is that the user needs only to exert a relatively low actuating force on the triggering lever 34 to open the valve 20. This facilitates the handling of the valve gun 10. During the first phase of the pivotal movement of the triggering lever 34, the closing body 68 is lifted off the valve seat 72 to such an extent that the pressure of the liquid prevailing upstream of the valve seat 72 is considerably reduced, and, subsequently, the closing body 68 can be moved further into its open position with less opening force by the second contact roller 88 rolling on the second guide surface 56.

When the triggering lever 34 reaches its release position shown in FIG. 6, in which the closing body 68 assumes its open position, the coupling lever 32 is supported via the second contact roller 88 on the support surface 58. The flat support surface 58 has a third tangent 105 which in relation to the reference line 98 has a third angle of inclination 106 which is smaller than the second angle of inclination 104. It is expedient for the third angle of inclination 106 to be about 15° to approximately 40°, in particular, about 20° to approximately 35°.

Owing to the relatively small inclination of the support surface 58 to the reference line 98, only a relatively low holding force needs to be exerted by the user on the triggering lever 34 to hold the closing body 68 in its open position. The handling of the valve gun 10 is, therefore, very easy, in particular, the valve gun can be actuated by the user with low forces.

The handling of the valve gun 10 is also facilitated by the triggering lever 34 being arranged at the rear side of the handgrip 24 that faces away from the valve 20 as the valve gun 10 is thereby pressed into the palm of the user's hand grasping the handgrip 24 under the influence of the recoil of the liquid discharged via the valve outlet 76. The user does, therefore, not have to clasp the handgrip 24 with his fingers with a high degree of force in order to hold the triggering lever 34 in its release position.

Furthermore, the handling of the valve gun 10 is facilitated by the first locking member 39 being arranged at the front side of the handgrip 24 that faces the outlet 76. The first leg 42 of the first locking member 39 forms an actuating arm which can be pivoted by the user when grasping the handgrip 24 with his fingers to such an extent about the second pivot axis 41 that the second leg 46, which forms a locking arm, releases the triggering lever 34. The actuation of the triggering lever 34 and the first locking member 39, therefore, occur intuitively when grasping the handgrip 24, without the user having to change the position of his hand on the handgrip 24 to unlock the triggering lever 34. The valve gun 10 comprises the second locking member 40 in addition to the first locking member 39. The risk of the triggering lever 34 being inadvertently actuated can thereby be kept particularly low.

The invention claimed is:

1. A valve gun for a high-pressure cleaner, comprising an inlet channel with an inlet for supplying a pressurized liquid and an outlet channel with an outlet for discharging the liquid, a valve arranged in a flow path between the inlet and the outlet, a triggering member manually movable between a rest position for closing the valve and a release position for opening the valve, a first locking member manually movable between a locking position and an unlocking position for locking the triggering member in the rest position, and a handgrip graspable by the user with his hand to hold the valve gun, wherein the triggering member is arranged at a rear side of the handgrip that faces away from the outlet, and wherein the first locking member is arranged at a front side of the handgrip that faces the outlet, wherein the handgrip is constructed in the manner of a pistol grip and forms a fixed component, which is arranged between the triggering member and the first locking member, and wherein the actuation of the triggering member occurs in the direction opposite to the actuation of the first locking member.

2. The valve gun in accordance with claim 1, wherein the triggering member is mounted so as to be pivotable about a first pivot axis.

3. The valve gun in accordance with claim 2, wherein the handgrip has an upper end region allocated to the thumb and the index finger of the user and a lower end region facing away from the upper end region, the first pivot axis being arranged in the lower end region.

4. The valve gun in accordance with claim 1, wherein the first locking member is mounted so as to be pivotable about a second pivot axis.

5. The valve gun in accordance with claim 4, wherein the handgrip has an upper end region allocated to the thumb and the index finger of the user and a lower end region facing away from the upper end region, the second pivot axis being arranged in the upper end region.

6. The valve gun in accordance with claim 1, wherein the first locking member comprises an actuating arm and a locking arm, the actuating arm, in the locking position of the first locking member, protruding from the front side of the handgrip, and the locking arm, in the locking position of the first locking member, blocking movement of the triggering member from the rest position to the release position.

7. The valve gun in accordance with claim 6, wherein the locking arm has a freely rotatable roller at its free end.

8. The valve gun in accordance with claim 6, wherein the locking arm, in the unlocking position of the first locking member, extends into a recess of the triggering member.

9. The valve gun in accordance with claim 1, wherein the valve gun comprises a second locking member which is movable back and forth between a locking position and an unlocking position, the triggering member being lockable in the locking position and releasable in the unlocking position by the second locking member.

10. The valve gun in accordance with claim 9, wherein the second locking member is movably mounted on a region of the triggering member which, in the rest position of the triggering member, protrudes from the handgrip, the second locking member, in its locking position, protruding from the triggering member, and, in its unlocking position, extending fully into the triggering member.

11. The valve gun in accordance with claim 10, wherein the second locking member is displaceably mounted in an opening of the triggering member.

12. The valve gun in accordance with claim 1, wherein the valve comprises a closing body which, in a closed position, lies tight against a valve seat and is adapted to be acted upon by a valve plunger with an opening force to move the closing body into an open position at a distance from the valve seat, and wherein the triggering member is coupled to the valve plunger via a coupling lever mounted so as to be pivotable about a coupling lever axis, the coupling lever comprising an actuating element via which the valve plunger is adapted to be acted upon with the opening force, and the coupling lever comprising a first and a second force receiving element, the first force receiving element being acted upon first and the second force receiving element subsequently with a triggering force when the triggering member is moved from the rest position into the release position, the first force receiving element being at a greater distance from the coupling lever axis than the second force receiving element.

13. The valve gun in accordance with claim 12, wherein the triggering member comprises a first and a second force application element, the first force receiving element being positionable on the first force application element, and the second force receiving element being positionable on the second force application element.

14. The valve gun in accordance with claim 13, wherein the first force receiving element and the first force application element form a first guide surface and a first contact element contacting the first guide surface and movable along the first guide surface, and wherein the second force receiving element and the second force application element form a second guide surface and a second contact element contacting the second guide surface and movable along the second guide surface.

15. The valve gun in accordance with claim 14, wherein the angle of inclination of the tangent of the first guide surface at the momentary contact point of the first contact element in relation to a reference line oriented parallel to a longitudinal axis of the outlet channel is smaller than the angle of inclination of the tangent of the second guide surface at the momentary contact point of the second contact element in relation to the reference line.

16. The valve gun in accordance with claim 14, wherein the first guide surface and the second guide surface are of flat configuration.

17. The valve gun in accordance with claim 16, wherein at least one of the first guide surface and the second guide surface is aligned parallel to the coupling lever axis.

18. The valve gun in accordance with claim 14, wherein the first guide surface and the second guide surface are arranged on the triggering member, and wherein the first contact element and the second contact element are arranged on the coupling lever.

19. The valve gun in accordance with claim 14, wherein the first guide surface and the second guide surface are arranged at an end face of the triggering member that faces the coupling lever.

20. The valve gun in accordance with claim 15, wherein the second contact element, in the release position of the triggering member, lies against a support surface, with the angle of inclination of the tangent of the support surface in relation to the reference line being smaller than the angle of inclination of the tangent of the second guide surface at the momentary contact point of the second contact element in relation to the reference line.

21. The valve gun in accordance with claim 20, wherein the support surface is of flat configuration.

22. The valve gun in accordance with claim 20, wherein the support surface is arranged at an end face of the triggering member that faces the coupling lever between the first guide surface and the second guide surface.

* * * * *